United States Patent [19]

Kinoshita et al.

[11] 4,072,223

[45] Feb. 7, 1978

[54] CONTROL SYSTEM OF COIN-OPERATED LOCKER

[75] Inventors: Yoshio Kinoshita; Masayuki Iguchi, both of Himeji, Japan

[73] Assignee: Glory Kogyo Kabushiki Kaisha, Japan

[21] Appl. No.: 735,410

[22] Filed: Oct. 26, 1976

[30] Foreign Application Priority Data

Oct. 24, 1975 Japan ..... 50-128677
Dec. 18, 1975 Japan ..... 50-151362

[51] Int. Cl.[2] ..... G07F 17/10
[52] U.S. Cl. ..... 194/54
[58] Field of Search ..... 194/9 T, 59, 65, 51, 194/92, 1 N, 54

[56] References Cited

U.S. PATENT DOCUMENTS 3,460,662 8/1969 Kinoshita ..... 194/51
3,917,046 11/1975 Yorisue et al. ..... 194/9 T

*Primary Examiner*—Stanley H. Tollberg
*Attorney, Agent, or Firm*—Wenderoth, Lind & Ponack

[57] ABSTRACT

In a control system of a coin-operated locker comprising a time-lapse detecting section for producing a time-lapse output signal whenever a predetermined unitary time has passed, a control section for producing a control signal by receiving the time lapse output signal and a signal generated when the key is operated, and a stepping drive mechanism which under the control of the control section is driven to advance stepwise in one direction when the lock is unlocked and when an overtime fee charging operation is carried out, and in the opposite direction when a coin is inserted into the locker, the operation of a device for advancing the stepping drive mechanism in the opposite direction is stopped when it is advanced stepwise in the one direction, thereby to continue the drive of the mechanism in the one direction.

5 Claims, 11 Drawing Figures

+12V
+6V
COUNT CIRCUIT
(H) (E)
(M)
IN1
IN2
RESET
START · STOP

CONTROL SYSTEM OF COIN-OPERATED LOCKER

BACKGROUND OF THE INVENTION

This invention relates to control systems in coin-operated lockers.

In one of the conventional coin-operated lockers, its rental fee is charged by the day. More specifically, in this coin-operated locker, a coin or coins inserted into the locker by a user for the use of the locker are effective up to 12 o'clock at night that day, and an overtime fee is charged when he opens the locker after the midnight. That is, in this coin-operated locker, the overtime fee charging operation is carried out every midnight.

In another conventional coin-operated locker, a unitary period of time of use of the locker is predetermined for the payment of a unitary amount of money (which is a certain number of coins), and an overtime fee is charged whenever the predetermined unitary period of time passes after the use of the locker has started. That is, in this conventional coin-operated locker, the overtime fee charging operation is conducted whenever the unitary period of time passes.

These conventional coin-operated locker are disadvantageous in that troubles may arise if a user operates the locker so as to open it during the overtime fee charging operation. More specifically, the insertion of a coin during this period may adversely affect the operation of a stepping drive mechanism provided for charging the overtime fee, and the coin may be caught in a coin path or may be taken in by the locker without being counted as the overtime fee.

Furthermore, if, when a user is going to turn a key to open the locker after paying the overtime fee (inserting a coin into the locker), the overtime fee charging operation is carried out and therefore a mechanism for preventing the operation of the key is operated, the operation of the key to open the locker and the operation of the mechanism may take place at the same time. As a result, the lock lever of the lock operated by the key may undesirably catch the mechanism, or the operation of the stepping drive mechanism may be obstructed and at worst broken.

SUMMARY OF THE INVENTION

Accordingly, an object of this invention is to provide a control system in a coin-operated locker in which all of the above described difficulties accompanying conventional coin-operated lockers have been overcome.

More specifically, an object of the invention is to provide a control system of a coin operated locker having means which when a stepping drive mechanism thereof is advanced stepwise in one direction during an overtime fee charging operation, operates to stop the operation of an opposite-direction stepping drive section provided for advancing the stepping drive mechanism in the opposite direction, thereby to continue the drive of the stepping drive mechanism in the one direction.

The foregoing object and other objects of the invention have been achieved by the provision of a control system of a coin-operated locker which comprises: a time-lapse detecting section for producing a time-lapse output signal whenever a predetermined unitary period of time has passed starting from the time instant when said locker is used; a control section for producing a control signal by receiving, as input condition signals, the time lapse output signal from said time-lapse detecting section, and a signal generated by operating a key of a lock provided on said locker; a stepping drive mechanism which under the control of said control section is driven by stepping drive means to advance stepwise in one direction when said lock is unlocked and when an overtime fee charging operation is effected, and to advance stepwise in the opposite direction when a coin is inserted into said locker; and means for stopping, when said stepping drive mechanism is advanced stepwise in the one direction during said overtime fee charging operation, the operation of an opposite direction stepping drive section relating to the drive of said stepping drive mechanism in the opposite direction, so as to continue the drive of said stepping drive mechanism in the one direction.

According to the invention, coins are never caught in the coin-operated locker, and coins inserted thereinto are positively counted as an overtime fee. Furthermore, such troubles in the conventional coin-operated locker as the catching of the lock lever, and the obstruction of the operation of the stepping drive mechanism are never be caused in a coin-operated locker having a control system according to this invention.

The nature, utility and principle of the invention will be understood from the following detailed description and the appended claims when read in conjunction with the accompanying drawings, in which like parts are designated by like reference characters.

DETAILED DESCRIPTION OF THE INVENTION

Figure 1:
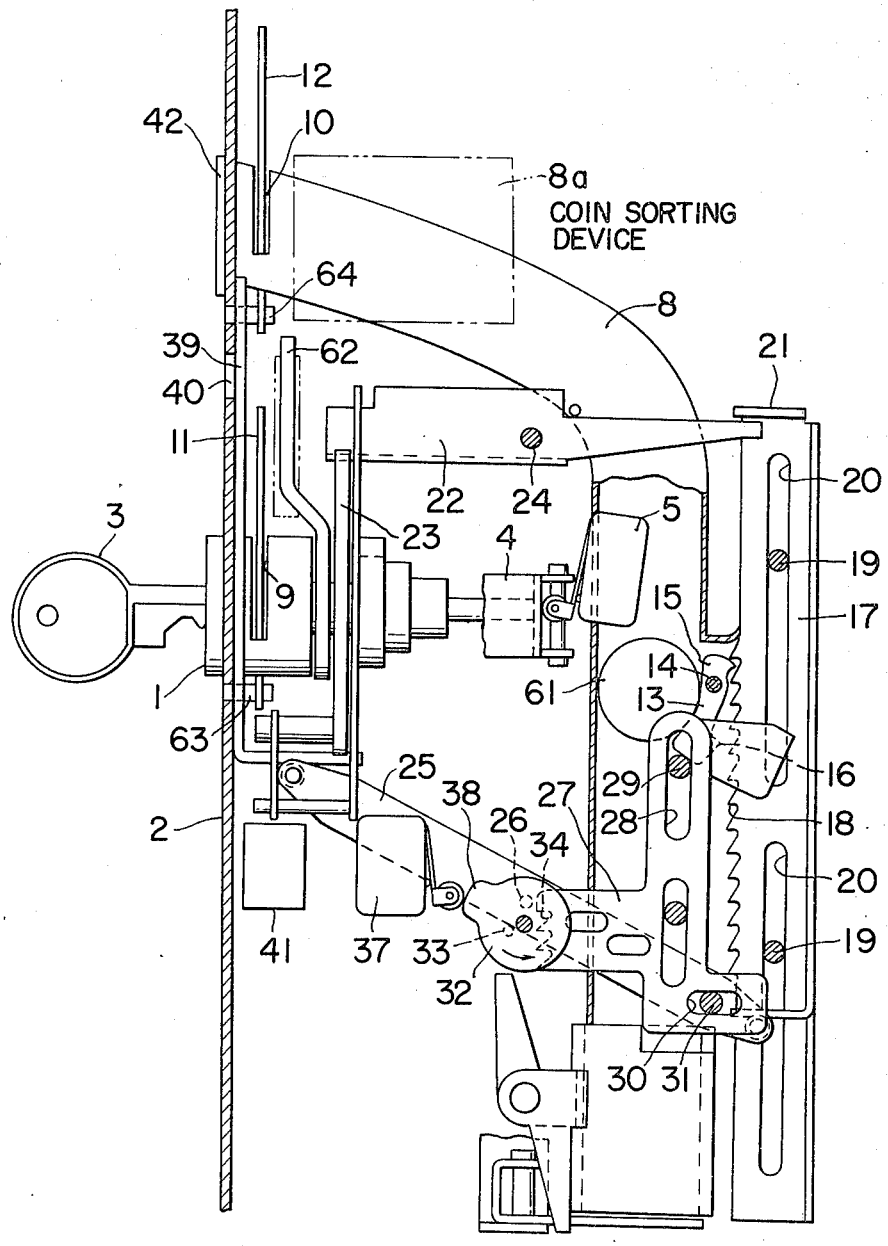
FIG. 1 is a side view, with parts sectioned, illustrating a mechanical arrangement of a coin-operated locker to which a first example of a control system according to the invention is applied.

A mechanical arrangement of a coin-operated locker to which a first example of a control system according to this invention is applied will be described with reference to FIG. 1 and FIG. 3.

The coin-operated locker comprises a cylinder lock 1 mounted on a front panel 2, and a locking lever 62 which is turned by a key 3 to allow the door of the locker to be opened or closed. Upon insertion of the key into the lock 3, a cam plate 4 is pushed backward to operate a key insertion and removal detecting switch 5.

A coin path 8 is communicated with a coin inlet 42 on the front panel 2 and with a coin sorting device 8*a*. In the coin path 8, there is provided an "L"-shaped ratchet lever 13 which is rotatably supported by a shaft 14. The ratchet lever 13 has pawls 15 and 16 which are caused to engage teeth 18 of a rental fee setting plate 17 alternately by displacement of the gravity center of the ratchet lever 13 or by the rocking motion of the ratchet lever 13 caused by the passage of a coin 61. The rental fee setting plate 17, being guided vertically by pins 19 and elongated slots 19 provided therein, tends to move downward because of its weight. The plate 17 has an engaging piece 21 at the upper end which, as the plate 17 moves downward, engages with one end of an engaging lever 22 which is rotatably supported by a shaft 24. This engaging lever 22 tends to turn itself counterclockwise because its gravity center is off the shaft 24 and thereby to insert its other end into an engaging plate 23 of the cylinder lock 1. Thus, the operation of the cylinder lock 1 is prevented by the engagement of the engaging lever 22 and the engaging plate 23.

The rental fee setting plate 17 is driven by the swinging motion of a drive plate 25 which is swingably supported by a shaft 26 and has one end portion coupled to an overtime fee charging drive plate 27 through an elongated slot 30 and a pin 31. The drive plate 25 serves to move the overtime fee charging drive plate 27 up and down in a vertical guide direction determined by a pin 29 and an elongated slot 28. The overtime fee charging drive plate 27 is moved upward by the rotation of a synchronous drive cam 32. More specifically, as the drive cam 32 is turned, a pin 33 provided thereon engages a tooth 34 of the overtime fee charging driveplate 27 to move the latter upward. The drive cam 32 is turned by an electric motor 36 in a stepping drive means 35 which will be described later. The drive cam 32 has a circular cam surface and a projection 38 protruded from this circular cam surface, and is kept abutted against the control lever of a switch 37.

The other end of the drive plate 25 supports the lower end of a display panel 39 against it weight which is adapted to display, through a window 40 in the front panel 2, for instance a period of time which has passed in the use of the locker, the number of coins or an amount of money to be inserted into the coin inlet, and so forth.

The coin-operated locker further comprises a key-turning-operation detecting switch 41 whose armature is tripped when the locking lever 62 is turned by the key 3 to lock the door of the locker.

Figure 2:
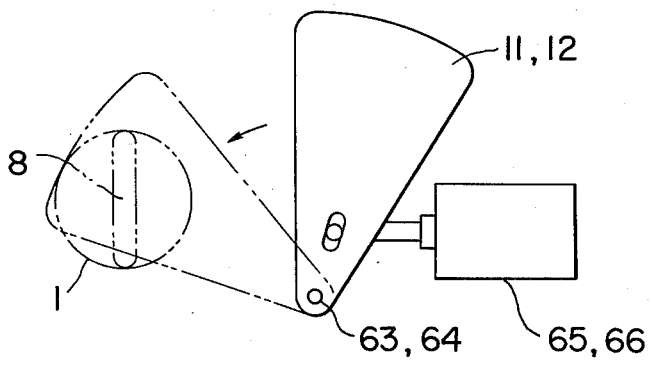
FIG. 2 is a front view illustrating means for inhibiting the insertion of a coin or a key in the coin-operated locker shown in FIG. 1.

The cylinder lock 1 and the coin path 8 are provided with slots 9 and 10, respectively, into which shutter plates 11 and 12 can be inserted, respectively. These shutter plates 11 and 12, as shown in FIG. 2, are pivotally supported by shafts 63 and 64 fixed to the front panel 2 and can be swung by the operations of plungers 65 and 66, respectively.

Now, a control device for controlling the above-described mechanical arrangement of the coin-operated locker will be described.

Figure 4:
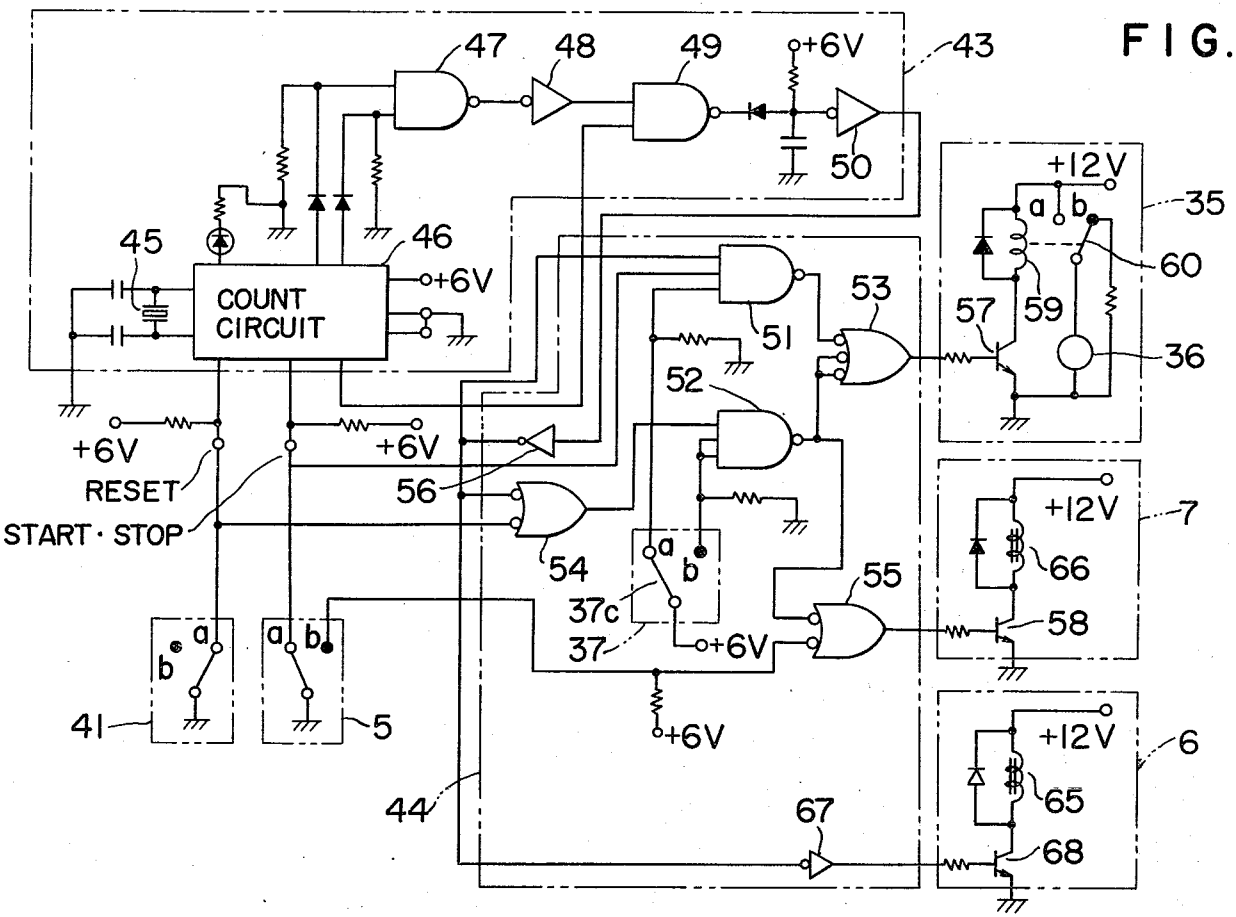
FIG. 4 is a block diagram illustrating the control system of the coin-operated locker shown in FIG. 1.

The control device, as shown in FIG. 4, a time-lapse detecting section 43, a control section 44, the above-described stepping operation drive means 35, a key insertion inhibiting means 6A, and a coin insertion inhibiting means 7A.

The time-lapse detecting section 43 is made up of a quartz oscillator 45, a count circuit 46, NAND circuits 47 and 49, inverter circuits 48 and 50, and other circuit elements. This section 43 operates in response to the operations of the key insertion and removal detecting switch 5 and the key-turning-operation detecting switch 41 to produce pulses, or time lapse output signals, at predetermined time intervals.

The control circuit 44 comprises NAND circuits 51 and 52, NOR circuits 53, 54 and 55, and an inverter circuit 56. The control circuit thus organized controls the stepping operation drive means 35 and the inhibiting means 6A and 7A relative to the key inserting, turning, and removing operations and also the output signal from the time lapse detecting section 43.

The drive means 35 comprises a transistor 57, an electric motor 36, and a relay 59 with an armature 60 to successively raise the overtime-fee charging drive plate 27 under the control of the control section 44.

The key-insertion inhibiting means 6A comprises a transistor 68, and the coil of the above-described plunger 65. This means 6 drives the shutter plate 11 according to the relationships between an output of the control means 44 and the operation of the key to inhibit the operation of the key.

The coin-insertion inhibiting means 7A comprises a transistor 58 to control the coil of the above-described plunger 66, thereby to keep the shutter plate 12 in the slot of the coin path 8, or to close the coin inlet 42.

The operation of the coin-operated locker employing the control system according to this invention will be described.

Before the locker is used by a user, the rental fee setting plate 17 is kept positioned as shown in FIG. 1, and the key is maintained inserted into the lock 1, and the coin inlet 42 is open. A coin 61 is inserted into the coin inlet 42 by the user. The coin 61 thus inserted is sorted by the coin sorting device 8*a*. If the coin is not acceptable to this locker, it is returned to the user through a coin returning outlet (not shown). If acceptable, it is dropped through the coin path 8, turning the ratchet lever 13 counterclockwise around the shaft 14. As was described before, the ratchet lever 13 has the pawls 15 and 16 which alternately engage the teeth 18 of the rental fee setting plate 17 to allow the latter 17 to move stepwise or tooth by tooth. Therefore, the above-described counterclockwise turning operation of the ratchet lever 13 causes the rental fee setting plate 17 to move downward as much as one tooth thereof. As a result of this downward movement, one end of the engaging lever 22 is depressed by the engaging piece 21 of the rental fee setting plate 17, and the engaging lever 22 is turned clockwise about the shaft 24, thereby disengaging from the engaging plate 23 to permit the operation of the key 3.

Turning the key 3 inserted into the cylinder lock 1 causes the locking lever 62 to lock the locker, whereupon the armature of the key-turning-operation detecting switch 41 is tripped to the contact *b* to release the reset state of the count circuit 46.

When the key 3 is removed from the lock 1, the armature of the key insertion and removal detecting switch 5 is tripped over to the contact *b*.

Upon tripping of the armature of the switch 5 to the contact *b*, the count circuit 46 starts a time integrating operation with an "H" signal employed as its start signal. All of the inputs of the NAND circuit 51 receive "H" signals, and the NOR circuit 53 connected to the NAND circuit 51 operates to render the transistor 57 of the stepping drive means 35 conductive. As a result, the relay 59 is excited to trip its armature 60 to the contact *a* to operate the electric mtoro 36.

Figure 3A:
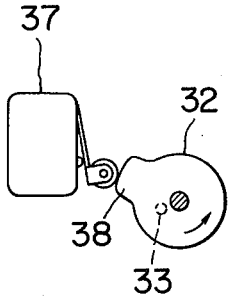
FIGS. 3(A) and 3(B) are explanatory diagrams for a description of a synchronous drive cam in the coin-operated locker shown in FIG. 1.

As the motor 36 rotates, the drive cam 32 kept in the standby state as in FIG. 3(A) begins to turn, and finally the armature 37*c* of the switch 37 drops from the projection 38 to the circular surface of the drive cam 32, that is, it is tripped from the contact *a* to the contact *b*. Accordingly, the NAND circuit 51 loses its one "H" input signal, and the motor 36 is stopped.

In this operation, as the armature of the switch 5 is at the contact *b*, the output of the NOR circuit 55 renders the transistor 58 of the coin-insertion inhibiting means 7A conductive, and the plunger 66 is energized. As a result, the shutter plate 12 closes the coin inlet 42 when the key 3 is removed from the lock.

Thus, the time counting operation for the use of the locker is started at the time instant when the key 3 is removed from the lock.

When a unitary period of time predetermined for the payment of a predetermined amount of money has been passed, the inverter circuit 50 in the time-lapse detecting section 43 produces an "H" signal, for instance, for five seconds. This "H" signal is inverted by the inverter circuit 56, and is applied to the NOR circuit 54 and the inverter circuit 67. The signal inverted by the inverter circuit 67 is applied to the transistor 68 to render the latter 68 conductive. As a result, the plunger 65 is energized, and the shutter plate 11 is moved into the slit 9 thereby to prevent the insertion of the key 3 into the cylinder lock 1. Thus, the key-insertion inhibiting mean serves to inhibit the insertion of the key 3 into the lock while the over-time fee charging operation is carried out (described later).

The output of the inverter circuit 56 is delivered through the NOR circuit 54 to the NAND circuit 52. This NAND circuit 52 produces an "L" signal when all the input terminals thereof receive "H" signal. The "L" signal from the NAND circuit 52 is applied through the NOR circuit 53 to the transistor 57 to render the latter conductive. Therefore, after the predetermined unitary period of time, the motor 36 in the stepping-operation drive means 35 is driven, and accordingly the drive cam 32 is turned, so that the pin 33 of the drive cam 32 engages a teeth 34 of the overtime fee charging drive plate 27 to raise the latter a distance corresponding to one tooth thereof. This upward movement of the overtime fee charging drive plate 27 causes the drive lever 25 to turn counterclockwise to raise the rental fee setting plate 17 a distance corresponding to one tooth thereof. In this operation, the ratchet lever 13 allows this upward movement of the rental fee setting plate and holds it there. Thus, the rental fee is increased by moving the rental fee setting plate 17 upward stepwise, that is, the overtime fee charging operation is automatically carried out.

During the overtime fee charging operation, the insertion of the key 3 into the lock 1 and the insertion of a coin (61) into the coin inlet 42 cannot be carried out (inhibited) as was described before.

As the drive cam 32 rotates, the armature 37*c* of the switch 37, as in FIG. 3(A), rides on the projection of the drive cam 32 and is therefore tripped to the contact *a*. As a result, the NAND circuit 52 loses its one "H" input signal, and therefore the motor 36 is stopped. Thus, the stepping drive means 35 has completed the overtime fee charging operation. This overtime fee charging operation is carried out whenever the predetermined unitary period of time has passed, and is accomplished within a short time, for instance, two seconds.

Figure 3B:
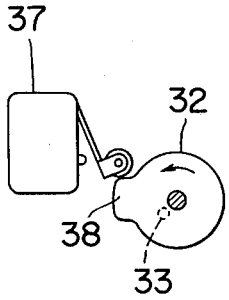

When the output of the inverter circuit 50 becomes an "L" signal thereafter, all the inputs of the NAND circuit 51 receives "H" signals. Therefore, as was described before, the motor 36 is operated to turn the drive cam 32, but is is stopped when the drive cam 32 comes to the position as shown in FIG. 3(B).

In the case when the user comes back to the locker to take out the baggage, he can insert the key 3 into the lock 1, whereupon the armature of the key insertion and removal detecting switch 5 is tripped, and the input signal to the NOR circuit is eliminated. As a result, the coin inlet 42 is opened. However, as the rental fee setting plate 17 has not raised yet, it is unnecessary to inert an additional coin, and the key 3 can be turned to open the lock 1.

In the case when the user takes out his baggage after the predetermined unitary period of time has passed, he inserts a coin 61 into the coin inlet 42 opened by the insertion of the key. The coin 61 strikes the ratchet lever 13 thereby to move downward the rental fee setting plate 17 a distance corresponding to one tooth thereof. When the necessary number of pieces of coins corresponding to the overtime fee have been inserted, the rental fee setting plate 17 operates to turn the engaging lever 22 clockwise so that the engaging lever 22 is disengaged from the engaging plate 23. Therefore, now it is possible to turn the key 3.

When the user inserts the key 3 into the cylinder lock 1, the cam plate 4 is moved in the direction of the key insertion, and the armature of the key insertion and removal detecting switch 5 is tripped to the contact *a* to immediately stop the operation of the time-lapse detecting section 43.

If the user turns the key 3 inserted into the lock 1 to open the latter, the armature of the key-turning-operation detecting switch 41 is tripped over to the contact *a* to provide a reset signal at an "L" level. This reset signal is applied to the count circuit 46 to reset the latter. This "L" signal is applied to the NOR circuit 54. Therefore, the motor 36 is started through the NAND circuit 52 and the NOR circuit 53. The driving power of the motor 36 raises the rental fee setting plate 17 as much as one tooth thereof, that is, the rental fee setting plate 17 is set at its standby position. This setting operation is stopped when the armature 37*c* of the switch 37, as shown in FIG. 3A, rides on the projection 38 of the drive cam 32 again. Thus, the coin-operated locker becomes ready for the following use.

The count circuit 46 of the time-lapse detecting section may be replaced by a mechanical or electrical timepiece.

In the above description, the shutter 12 serves to prevent the insertion of coins. However, the mechanical arrangement of the locker may be so designed that in that case a coin 61 is introduced into another coin path by the coin sorting device 8*a*, or it is led into another coin path branched from the coin path 8.

Furthermore, the locker may be so designed that the key-turning-operation detecting switch 41 operates in response to the opening and closing of the door.

A second example of the control system according to the invention will be described. First, a mechanical arrangement of a coin-operated locker to which this control system is employed will be described with reference to FIGS. 5 and 6.

The locker comprises a cylinder lock 1 mounted on a front panel 2, and a locking lever 62 which is turned by a key 3 to allow the door of the locker to be opened or closed. Upon insertion of the key into the lock, a cam plate 4 is pushed backward to operate a key insertion detecting switch 5 and a shutter lever 6. More specifically, when the cam plate 4 is moved in the direction of the arrow A (in FIG. 6) by inserting the key 3 into the lock, the shutter lever 6 is turned around a shaft 7 in the direction of the arrow B against the elasticity of a spring 43 connected to the shutter lever 6, and therefore a shutter plate 10 provided on one end of the shutter lever 6 is moved out of a slit 9 provided in a coin path 8 to open a coin inlet 42. This shutter lever 6 can be fixedly held also by excitation of a solenoid 12 in an operation inhibiting means 11 (described later). When the shutter lever 6 is fixedly held, it abuts against the cam plate 4 to prevent the insertion of the key into the cylinder lock 1.

The coin path 8 is communicated with the coin inlet 42 on the front panel 2 and with a coin sorting device 8*a*. In the coin path 8, there is provided an "L"-shaped ratchet lever 13 which is rotatably supported by a shaft 14. The ratchet lever 13 has pawls 15 and 16 which are caused to engage teeth 18 of a rental fee setting plate 17 alternately by displacement of the gravity center of the ratchet lever 13. The rental fee setting plate 17, being guided vertically by pins 19 and elongated slots 20, tends to move downward because of its weight. The plate 17 has an engaging piece 21 at the upper end which as the plate 17 moves downward, engages one end of an engaging lever 22. The engaging lever 22 is rotatably supported by a shaft 24. This engaging lever 22 tends to turn itself counterclockwise because its gravity center is off the shaft 24 and thereby to insert its other end into an engaging plate 23 of the cylinder lock 1. Thus, the operation of the cylinder lock 1 is prevented by the engagement of the engaging lever 22 and the engaging plate 23.

The rental fee setting plate 17 is driven by the swinging motion of a drive lever 25 which is swingably supported by a shaft 26 and is coupled at one end to an overtime fee changing drive plate 27 through an elongated slot 30 and a pin 31. The drive plate 25 moves the overtime fee changing drive plate 27 up and down in a vertical guide direction determined by a pin 29 and an elongated slot 28. The overtime fee charging drive plate 27 is moved upward by rotation of a synchronous drive cam 32. More specifically, as the drive cam 32 is turned, a pin 33 provided thereon engages a tooth 34 of the overtime fee charging drive-plate 27 to move the latter upward. The drive cam 32 is turned by an electric motor 36 in a stepping drive means 35 which will be described latter. The drive cam 32 has a circular cam surface and a projection 38 protruded from the circular cam surface, and is kept abutted against the control lever of a switch 37.

The other end of the drive plate 25 supports the lower end of a display panel 39 against its weight which is adapted to display through a window 40 in the front panel 2, for instance the period of time which has elapsed for the use of the locker, the number of pieces of coins or an amount of money to be inserted into the coin inlet, and so forth.

The coin-operated locker further comprises a key-turning-operation detecting switch 41 which is operated when the locking lever 62 is turned in the locking direction with the key 3 turned to lock the door of the locker after the door has been closed, and also when the locking lever 62 is turned in the unlocking direction with the key turned to unlock the door. In the case when the key 3 is turned in the unlocking direction, the switch 41 operates as a reset switch for resetting a time-lapse detecting section (described later). The cooperative mechanism between the switch 41 and the locking lever 62 is not shown for simplfication.

Now, an electrical control device for controlling the above-described coin-operated locker will be described.

Figure 7:
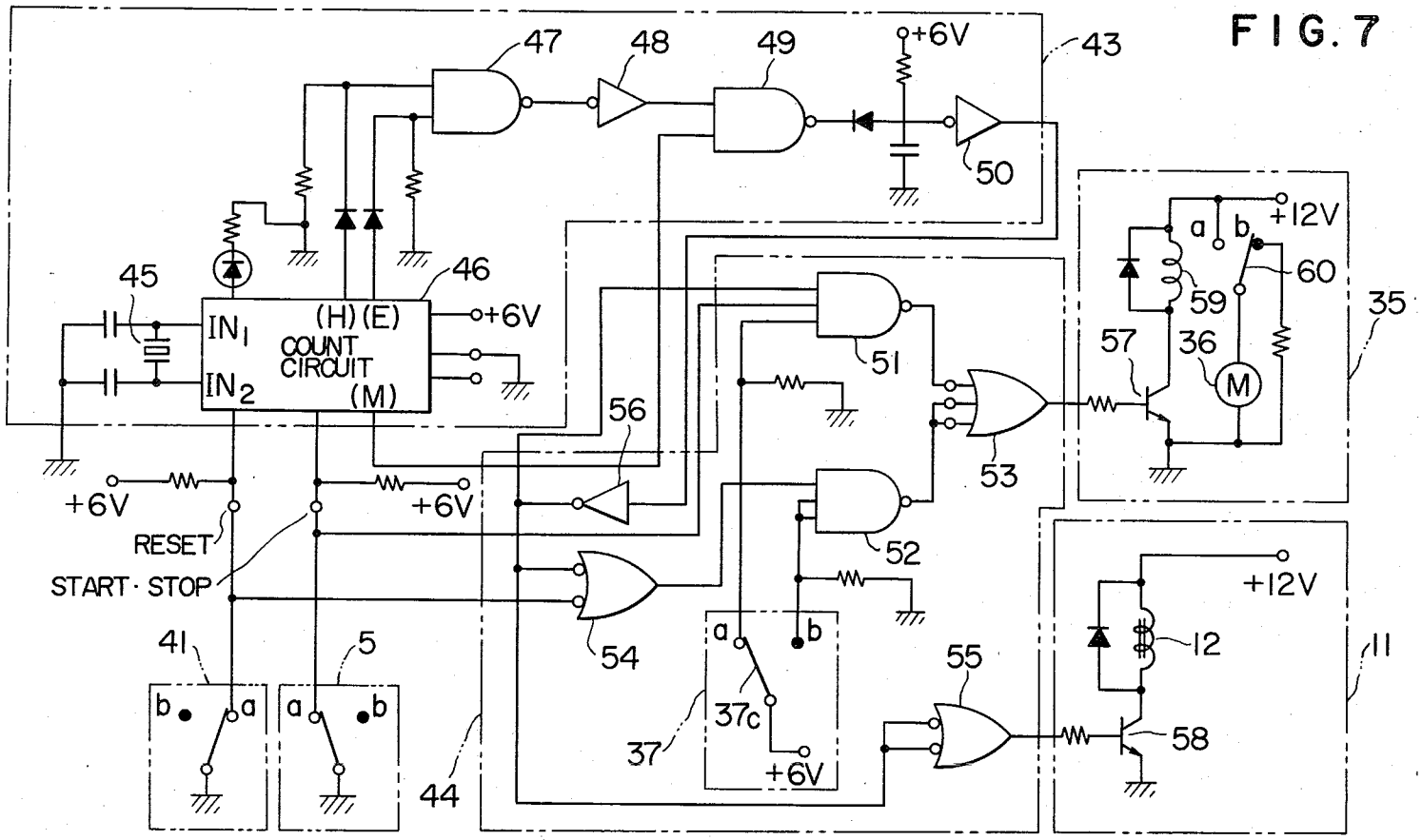
FIG. 7 is a block diagram illustrating the control system of the coin-operated locker shown in FIG. 6.
Figure 9:
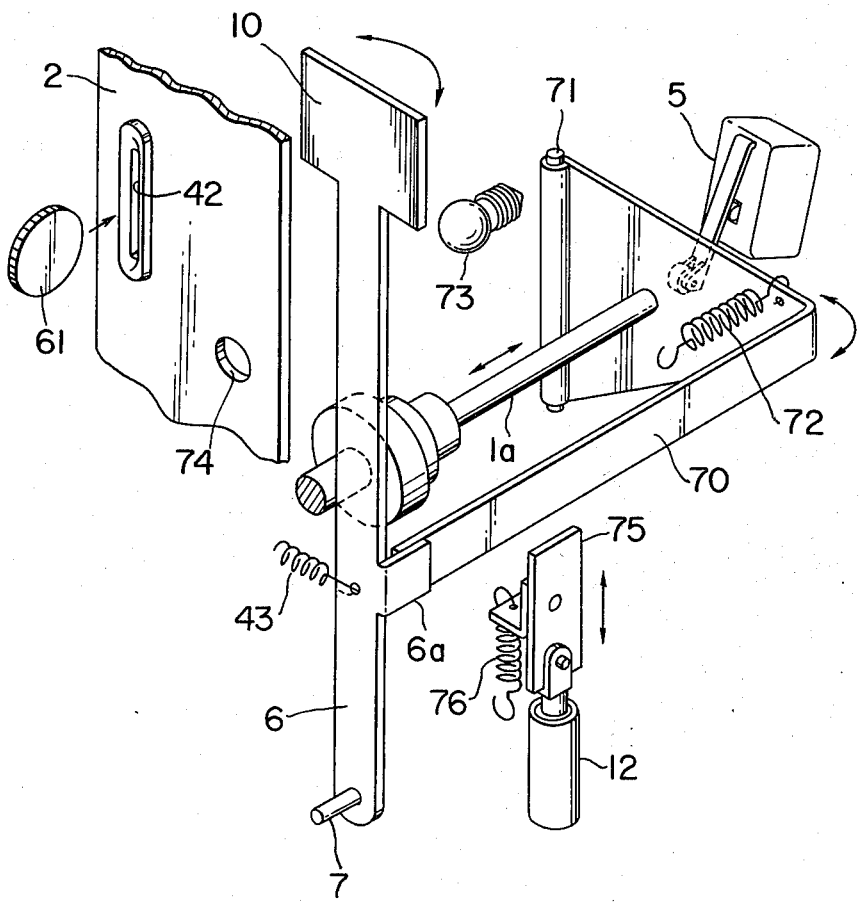
FIG. 9 is a perspective view showing another example of the means for blocking the coin inlet.

The electrical control device, as shown in FIG. 7, comprises a time lapse detecting section 43, a control section 44, the above-described operation inhibiting means 11, and stepping drive means 35.

The time lapse detecting section 43 is made up of a quartz oscillator 45, a count circuit 46, NAND circuits 47 and 49, inverter circuits 48 and 50, and other circuit elements. This section 43 operates in response to the operations of the key insertion detecting switch 5 and the key-turning-operation detecting switch 41 to produce pulses, or time lapse output signals, at predetermined time intervals.

The control section 44 comprises NAND circuits 51 and 52, NOR circuits 53, 54 and 55, and an inverter circuit 56, and controls the stepping drive means 35 and the operation inhibiting means 11 in response to the key inserting, turning and removing operations and also the output signal from the time lapse detecting section 43.

The stepping drive means 35 comprises a transistor 57, an electric motor 36, and a relay 59 with an armature 60 to successively raise the overtime fee charging drive plate 27 under the control of the control section 44.

The operation inhibiting section 11 comprises a transistor 58 and the above-described solenoid 12 so as to inhibit both the operation of the key and the insertion of a coin according to the relationships between an output of the control section and the operation of the key.

The operation of the control system of the coin-operated locker thus organized will be described.

Figure 5:
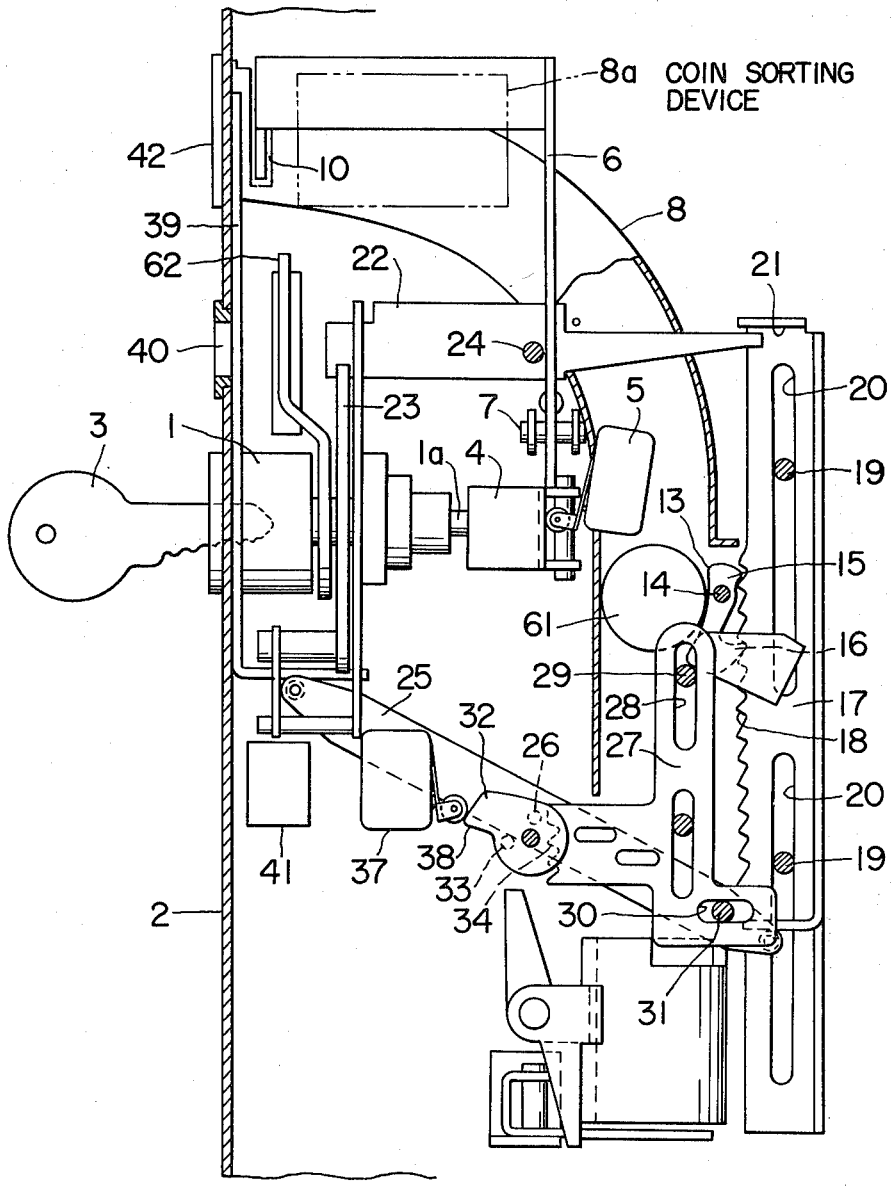
FIG. 5 is a side view, with parts sectioned, illustrating a mechanical arrangement of a coin-operated locker to which a second example of the control system according to the invention is applied.
Figure 6:
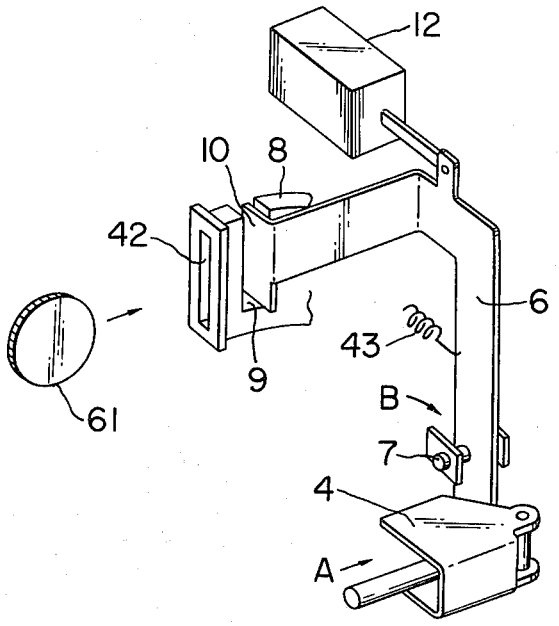
FIG. 6 is a perspective view showing means for blocking the coin inlet of the coin-operated locker.

Before the locker is used, the rental fee setting plate 17 is positioned as shown in FIG. 5, and the coin inlet 42 is open because the key 3 is maintained inserted into the lock. A coin 61 is inserted by a user into the coin inlet. The coin is sorted by the coin sorting device 8*a*, and if it is not acceptable to this locker, it is returned to the user through a coin returning outlet (not shown). If acceptable, it is dropped through the coin path 8, turning the ratchet lever 13 counterclockwise around the shaft 14. As was described before, the ratchet lever 13 has the pawls 15 and 16 which engage alternately the teeth 18 of the rental fee setting plate 17 so as to allow the latter 17 to move stepwise or one tooth by one tooth. Therefore, the counterclockwise turning operation of the ratchet lever 13 causes the rental fee setting plate 17 to move downward as much as one tooth thereof. As a result of this downward movement, the engaging lever 22 is turned clockwise about the shaft 24, thereby disengaging from the engaging plate 23 to permit the operation of the key 3.

Turning the key 3 inserted into the cylinder lock 1 causes the locking lever 62 to lock the locker, and the armature of the key-turning-operation detecting switch 41 to trip to the contact *b*.

When the key 3 is thereafter removed from the lock 1, the armature of the key insertion detecting switch 5 is tripped to the contact *b*, and the shutter lever 6 is turned around the shaft 7 by the spring 43 to prevent other persons from inserting coins into the coin inlet.

Upon tripping of the armature of the switch 5 to the contact *b*, the count circuit 46 starts a time counting operation with an "H" signal employed as its start signal. All of the inputs of the NAND circuit 51 in the control section 44 receive "H" signals, and the NOR circuit 53 connected to the NAND circuit 51 operates to render the transistor 57 of the stepping operation drive means 35 conductive. As a result, the relay 59 is excited to trip its armature 60 to the contact *a* to operate the electric motor M.

As the motor M rotates the drive cam 32 kept in the standby state as in FIG. 8 (A) begins to turn, and finally the armature 37*c* of the switch 37 drops from the projection 38 to the circular surface of the drive cam 32, that is, it is tripped from the contact *a* to the contact *b*. Accordingly, the NAND circuit 51 loses its one "H" input signal, and the motor M is stopped. Thus, the use of the locker starts when the key 3 is removed from the lock.

When a unitary period of time predetermined for the payment of a predetermined amount of money has been passed, an overtime fee charging operation is carried out as follows.

First, the inverter circuit 50 in the time lapse detecting section 43 produce an "H" signal, for instance, for five seconds. This "H" signal is inverted by the inverter circuit 56, and is applied to the NOR circuits 54 and 55. Accordingly, the NOR circuit 54 renders the transistor 58 conductive, and the solenoid 12 connected to the transistor 58 is excited. The coin inlet 42 is forcibly maintained closed by the shutter plate 10 by the selenoid thus excited, and the shutter lever 6 is abutted against the cam plate 4 to prevent the insertion of the key 3. Thus, the operation inhibiting means 11 operates to inhibit the insertions of the key and the coin during the overtime fee charging operation (described later).

On the other hand, the NOR circuit 54 produces an output signal when it receives the output of the time lapse detecting sections 43 or the "L" signal of the key turn detecting switch 41. The output signal thus produced renders the transistor 57 conductive through the NAND circuit 52 and the NOR circuit 53. Thus, after the predetermined unitary time, the motor M in the stepping operation drive means 35 is driven, and accordingly the drive cam 32 is turned, so that the pin 33 of the cam 32 engages a tooth 34 of the overtime fee charging drive plate 27 to raise the latter a distance corresponding to one tooth thereof. This upward movement of the overtime fee charging drive plate 27 causes the drive lever 25 to turn counterclockwise to raise the rental fee setting plate 17 a distance corresponding to one tooth thereof. In this operation, the ratchet lever 13 allows this upward movement of the rental fee setting plate, and holds it there. Thus, the overtime fee charging operation is automatically carried out with the rental fee setting plate raised. In addition, the insertion of the key 3 into the lock and the insertion of a coin 61 into the coin inlet 42 cannot be carried out during the overtime fee charging operation, as was described above. That is, during this period the coin inlet 42 is kept closed not only mechanically but also electrically.

Figure 8A:
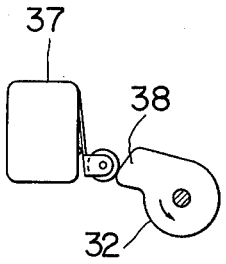
FIGS. 8A and 8B are explanatory diagrams for a description of the operation of a drive cam of the coin-operated locker shown in FIG. 6.
Figure 8B:
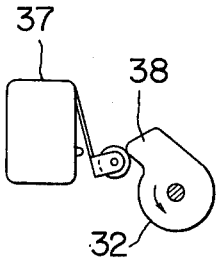

As the drive cam 32 rotates, the armature 37*c* of the switch 37, as in FIG. 8A, rides on the projection 38 of the drives cam 32 and is therefore tripped to the contact *a*. As a result, the NAND circuit 52 loses one "H" input signal, and therefore the motor M stops. Thus, the stopping operation drive means 35 has completed the overtime fee charging operation. This overtime fee charging operation is carried out whenever the predetermined unitary time has passed, and is accomplished within a short time, for instance, two seconds.

Thereafter, when the output of the inverter circuit 50 becomes an "L" signal, all of the inputs of the NAND circuit 51 receive "H" signals, and therefore, as was described before, the motor 36 is rotated. However, the drive cam 32 is turned to the state shown in FIG. 8(B), the motor is stopped.

In the case when the user comes back to the locker within the unitary time to take out his baggage, the rental fee setting plate 17 has not been raised yet. Therefore, if he turns the key to open the lock without inserting an additional coin into the coin inlet, the locking lever 63 is disengaged from a slot (not shown) provided in the door, thus opening the door of the locker.

In the case when the user is going to open the door after the predetermined unitary time has passed, he have to follow the following steps.

He inserts the key 3 into the lock 1. Upon insertion of the key, the cam plate 4 is displaced in the direction of this key insertion, and the shutter lever 6 is turned to open the coin inlet (42).

Then, a coin is additionally inserted into the coin inlet 42. The coin, striking the ratchet lever 13, causes to fall the rental fee setting plate 17, a distance corresponding to one tooth thereof. When the necessary number of pieces of coins corresponding to the overtime fee have been inserted, the rental fee setting plate 17 operates to turn the engaging lever 22 clockwise so that the engaging lever 22 is disengaged from the engaging plate 23. Therefore, now it is possible for him to turn the key 3 to open the door.

On the other hand, upon insertion of the key 3, the armature of the key insertion detecting switch 5 is tripped over to the contact *a*. As a result, the count circuit 46 receives an "L" signal as a stop signal, thereby to suspend the time counting operation. When the user turns the key 3 inserted in the lock 1 to unlock the locker, the armature of the key turn detecting switch 41 is tripped over to the contact *a*. As a result, the count circuit 46 is reset by a reset signal at an "L" level from the switch 41. This "L" level signal is applied also to the NOR circuit 54, and therefore the motor M in the stepping operation drive means 35 is driven through the operations of the gate circuits 52 and 53. The driving force of the motor M raises the rental fee setting plate 17 a distance corresponding to one tooth thereof, that is, the plate 17 is set ready for the next use of the coin-operated locker. This operation is ceased when the projection 38 of the drive cam 32 is met with the armature 37*c* of the switch 37 as is shown in FIG. 8(A). Thus, the coin-operated locker becomes ready for the next use.

Briefly summarized, in the operation of the above-described example, the counting of rental time is started at the time when the key turned to lock the locker (in which a piece of baggage has been placed) is removed from the lock, and this rental time counting operation is suspended at the time when the key is inserted into the lock to take a piece of baggage out of the locker. Then, the time lapse detecting section 43 is reset at the time when the key thus inserted is turned to unlock the locker.

The control system may be so designed that the rental time counting operation, that is, the operation of the time-lapse detecting section 43 is started at the time when the key is turned, instead of the time when the key is pulled out, or at the time when the door is closed after the piece of baggage has been put in the locker. Furthermore, the system may be so designed that the time-lapse detecting section 43 is reset at the time when, after the unlocking operation has been carried out, the door is opened.

In this example also, the count circuit 46 of the time lapse detecting section 43 may be substituted by a mechanical or electrical time piece. Furthermore, in the above description, the insertion of a coin 61 is obstructed by the shutter plate 10; however, the mechanical arrangement of the locker may be so designed that a coin 61 is introduced into another coin path by the coin sorting device 8a or it is led into another coin path branched from the coin path 8.

The operation inhibiting means 11 of the coin inlet may be modified. One example of the modification is shown in FIG. 8. In this example, a "L"-shaped key-insertion detecting plate 70 is rotably supported by a supporting shaft 71 and is energized by a spring 72. The plate 70 abuts against an engaging piece 6a of the shutter lever 6 at its one end portion, and is pushed by a rod 1a of the cylinder lock 1 to operate the key insertion and removal detecting switch 5. The solenoid 12 pushes a stop plate upward against the electicity of a spring 76 to limit the movement of the detecting plate 70. Furthermore, an indication lamp 73 is provided at a suitable position, and a window 74 is provided in the front panel 2 to show the indication lamp 73.

The operation of the modification will be described. Upon insertion of the key, the detecting plate is moved to operate the switch 5, and the shutter lever 6 is also moved so that a coin 61 inserted can be introduced into the locker. While the overtime fee charging operation is carried out, the insertion and introduction of a coin 61 are prevented, because the solenoid 12 pushes the stop plate 75 upward to obstruct the movement of the detecting plate 70.

The lighting condition of the lamp 73 is changed according to the operating states of the locker. For instance, the lamp 73 is intermittently turned on like a winker while the locker is used; it is continuously lighted while the key is inserted; and it is kept turned off when the locker is not used. These operations of the lamp can be obtained by interconnecting the lamp to the various switches of the control system.

In the above-described examples are employed a method of obstructing the insertion of the key; however, it goes without saying that a method of preventing the key from being turned to open the lock may be employed. For instance, the same plate as the shutter plate 11 in the first example may be provided so as to advance in the direction of opening the lock, thereby to prevent the movement of the locking lever.

It should be noted that since there are a variety of mechanisms or circuits as the overtime fee charging section of the coin-operated locker, all or two or one of the methods of obstructing the insertion or introduction of a coin, of preventing the insertion of the key, and of preventing the key from being turned in the direction of opening the lock can be employed according to the type of overtime fee charging sections.

We claim:

1. A control system of a coin-operated locker which comprises:

a time-lapse detecting section for producing a time-lapse output signal whenever a predetermined unitary period of time has passed starting from the time instant when said locker is used;

b. a control section for producing a control signal by receiving, as input condition signals, the time lapse output signal from said time-lapse detecting section, and a signal generated by operating a key of a lock provided on said locker;

c. a stepping drive mechanism which under the control of said control section is driven by stepping drive means to advance stepwise in one direction when said lock is unlocked and when an overtime fee charging operation is effected, and to advance stepwise in the opposite direction when a coin is inserted into said locker; and d. means for stopping, when said stepping drive mechanism is advanced stepwise in the one direction during said overtime fee charging operation, the operation of an opposite direction stepping drive section relating to the drive of said stepping drive mechanism in the opposite direction, so as to continue the drive of said stepping drive mechanism in the one direction.

2. A control system as claimed in claim 1, in which said means is means for preventing a coin from being taken in by said operation drive means.

3. A control system as claimed in claim 2, in which said means for preventing a coin from being taken in by said stepping drive means is means for blocking the insertion of a coin into a coin inlet of said locker.

4. A control system as claimed in claim 1, in which said means is unlocking preventing means for preventing a unlocking operation.

5. A control system as claimed in claim 4, in which said unlocking preventing means is key-insertion inhibiting means for inhibiting the insertion of said key into said lock.

* * * * *